US005845813A

United States Patent [19]

Werner

[11] Patent Number: 5,845,813

[45] Date of Patent: Dec. 8, 1998

[54] TOOTHPASTE DISPENSER

[76] Inventor: Barry J. Werner, 1780 Calypso Ave., Apt. 11, Bethlehem, Pa. 18018

[21] Appl. No.: 879,631

[22] Filed: Jun. 20, 1997

[51] Int. Cl.[6] ..... B65D 35/28

[52] U.S. Cl. ..... 222/101; 222/103

[58] Field of Search ..... 222/92, 95, 101, 222/103, 105

[56] References Cited

U.S. PATENT DOCUMENTS

| | | | |
|---|---|---|---|
| 2,837,243 | 6/1958 | Zebnik | 222/101 |
| 4,234,104 | 11/1980 | Apuzzo, Jr. et al. | 222/94 |
| 4,258,864 | 3/1981 | Karamanolis et al. | 222/96 |
| 4,403,714 | 9/1983 | Kane | 222/101 |
| 5,050,773 | 9/1991 | Choi | 222/63 |
| 5,441,172 | 8/1995 | Yu | 222/52 |
| 5,499,742 | 3/1996 | Ives, Sr. | 222/101 |

FOREIGN PATENT DOCUMENTS

| | | |
|---|---|---|
| 3936344A1 | 5/1991 | Germany . |
| 2216863 | 10/1989 | United Kingdom . |
| 2255073 | 10/1992 | United Kingdom . |

*Primary Examiner*—Joseph A. Kaufman
*Attorney, Agent, or Firm*—Richard C. Litman

[57] ABSTRACT

A wall mountable toothpaste dispenser operated by electrical power from the bathroom outlet or batteries. A sliding horizontal cylindrical wedge presses a toothpaste tube against a fixed vertical planar wedge with an inclined surface for squeezing a dose onto a toothbrush. The cylindrical wedge is moved by a line and pulley system driven by a motor and spur gearing. The dispenser is made from inexpensive materials and any mechanical part can be repaired by the user. Other viscous liquid products can be dispensed by this device.

20 Claims, 1 Drawing Sheet

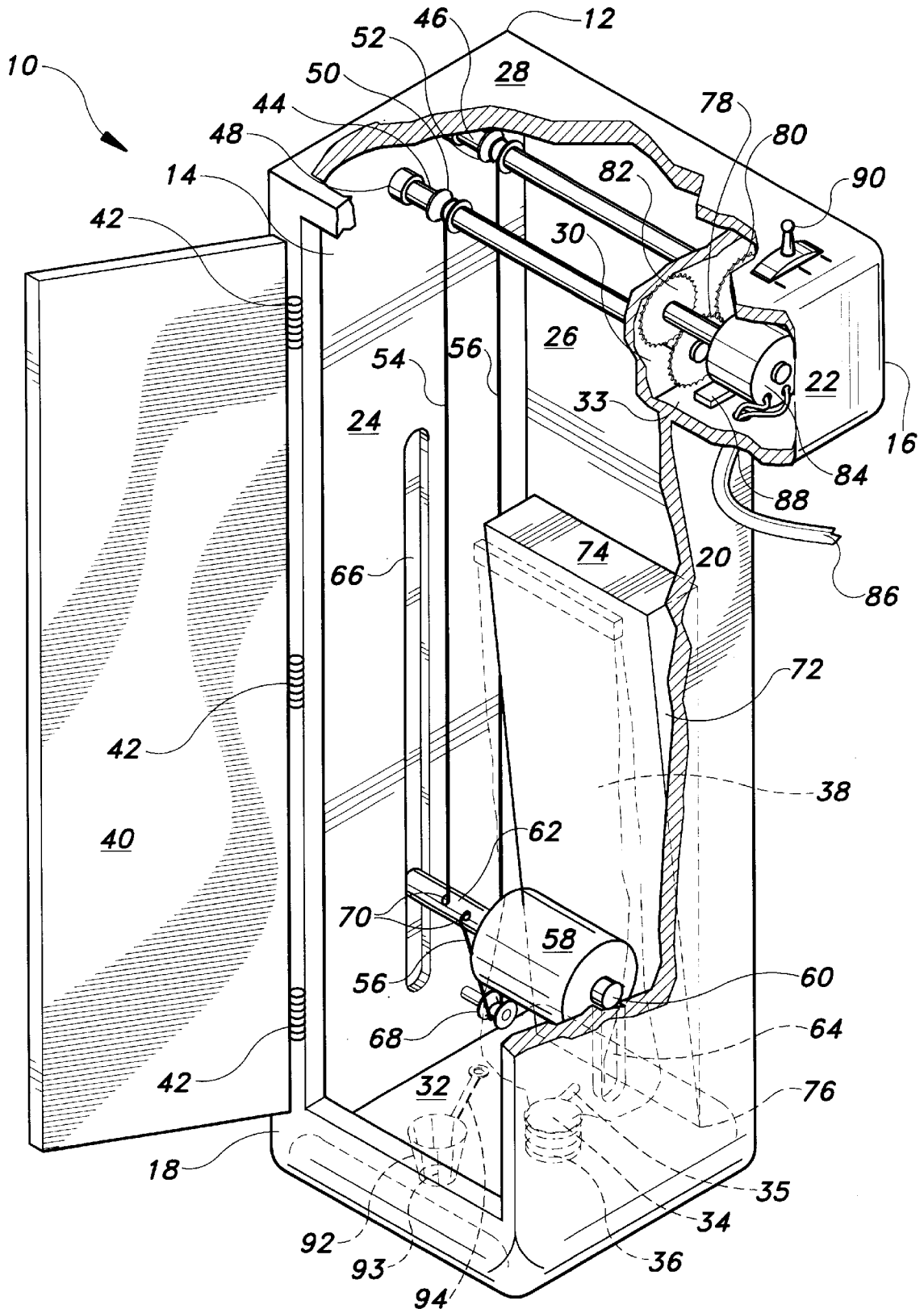
10
12
14
16
18
20
22
24
26
28
30
32
33
34
35
36
38
40
42
44
46
48
50
52
54
56
58
60
62
64
66
68
70
72
74
76
78
80
82
84
86
88
90
92
93
94

TOOTHPASTE DISPENSER

BACKGROUND OF THE INVENTION

1. Field of the invention

The present invention relates to a toothpaste dispenser to be positioned on a bathroom wall. The dispenser incorporates a toothpaste tube of any conventional size with its nozzle exposed on the bottom with either its own cap or a tethered substitute cap. A sliding horizontal cylindrical wedge cooperates with a fixed wedge with an incline to squeeze the toothpaste tube by a mechanism operated by an electrical system comprising a circuit board, a three-way toggle or slide switch and an electrical source from converted house current or battery. A cylindrical wedge is attached to thin lines wound by pulleys on rods which are controlled by gearing driven by an electric motor. The mechanical parts can be readily maintained by the user by the provision of a large front door and a modular mechanical-electrical compartment.

2. Description of Related Art

The relevant art describes various fluid dispensers from tubes or other flexible containers operated by hand or a motor, but not with a combination of a wedge with an incline and a line-connected, sliding cylindrical wedge driven by electrically operated gearing. The relevant art will be discussed according to their perceived relevance to the present invention.

U.S. Pat. No. 5,441,172 issued on Aug. 15, 1995, to Abraham Yu describes an apparatus for automatically dispensing a controlled amount of the paste content of a collapsible tube and notifying the user of the dispensed paste electronically. The wall-mounted dispenser apparatus has within the apparatus accessible through a large side door, two rollers with meshed gears at each end confined in a rack with two sides to squeeze the paste from a tube into another compartment with a separate bottom door. Through the use of an electric eye to detect a toothbrush inserted through the bottom door opening and below the toothpaste tube nozzle, the mechanism for squeezing the tube is activated until the toothbrush is removed. The gearing system requires at least eight gears, two motors and two rollers, whereas the present invention requires three gears, one motor operated by a circuit board, one roller and a wedge. Moreover, the sophisticated electronic gadgetry for automatic dispensing dentifrice on an inserted toothbrush would be an expensive addition to a economical toothpaste dispenser as in the present invention.

U.S. Pat. No. 5,499,742 issued on Mar. 19, 1996, to Kenneth L. Ives, Sr. describes a hand operated reciprocating toothpaste dispenser having a rectangular box frame mountable to a wall by a pair of suction cups. The front box cover frictionally fits over the rear box frame. A roller with a jointed handle advances the roller downward in steps governed by a detented rack having two side walls and pivotable at the bottom. A slot at the bottom provides the opening for the tube's nozzle. This hand operated dispenser is structurally distinct from the present automated two-wedge invention and lacks the wedge of the present invention.

German Patent Application No. DE 39 36 344 Al published on May 8, 1991, for Werner Buttner describes a toothpaste dispenser consisting of a three-compartment housing for the toothpaste with a top cover for insertion of the toothpaste tube in a support consisting of inverted L-shaped frames with limited depth on each sidewall and the front wall of the housing. A single roller is pulled down over the toothpaste tube by a rein (as best understood) on either end of the roller and anchored at one end on the floor of the first compartment. The other end of each rein travels through apertures through the middle compartment to the bottom compartment wherein each rein is anchored on a separate ratcheted winder on a common axle which is held in place by a two-fingered ratchet lever. As a toothbrush is pushed into a spring loaded sliding box, the box pushes against another spring and a dose of toothpaste is dispensed. The sliding box pushes a pivoting finger which apparently advances a large tooth on the centered main ratchet wheel and the two side minor ratchets which were locked in place by two fingers of the ratchet lever. When the roller reaches the bottom of the top compartment, the roller tension can be released by a pull cord extending through a hole in the bottom compartment to release the ratchet lever from its place on the two sides of ratchet teeth. There is no suggestion to automate this mechanism or to control the roller by one end of the roller. The use of two wedges is not taught.

United Kingdom Patent Application No. 2,216,863 A published on Oct. 18, 1989, for Mohammad Sharif describes a hand operated squeezing device for collapsible tubes. A rectangular block contains a pair of rollers geared at the ends to mesh under the pressure of springs. One or more operating knobs can be engageable at either end or on both rollers. The surface of the rollers can be roughened with various designs. The toothpaste tube is inserted at its end from the top of the squeezing device. The reference is distinguished because the device bears little structural similarity to the present invention.

United Kingdom Patent Application No. 2,255,073 A published on Oct. 28, 1992, for Malenco Limited describes a multiple dispensing system for progressively and simultaneously squeezing two container bags hung on a vertical support to form a mixture, e.g., epoxy adhesive, which is expelled from a common mixing head. The roller has a toothed spindle at each end which meshes with a toothed rack on the vertical support. The drive mechanism to perform the squeezing action is not disclosed. The structural differences as shown distinguish this reference.

U.S. Pat. No. 4,258,864 issued on Mar. 31, 1981, to Peter K. Karamanolis et al. describes an automatic toothpaste dispenser with four gears in the top portion including a small pinion drive gear from an electric motor or a battery driving a series of three large drive gears of which the central connecting gear lacks an axle. The single roller has its ends threaded to the vertical gear axles by carriage blocks. One switch opens and closes a gate for the dispensing of toothpaste. A second switch causes the roller to return to its starting position. The intricate mechanism bears little resemblance to the present invention in that the roller advances by rotating down or up the axles of the drive gears.

U.S. Pat. No. 4,403,714 issued on Sep. 13, 1983, to David M. Kane describes an automatic toothpaste dispenser which is positioned horizontally in a housing with the roller advancing and driven by a lead screw mechanism. A dispensing adapter provides for any common sized nozzle. An adapter nozzle closure serves as a motor switch actuation element. The upper compartment contains a toothpaste tube and a roller on a roller carriage positioned on a lead screw located in a lower compartment. Roller support brackets pass through parallel slots in the platen which separates the compartments. An electric motor in the lower compartment rotates the lead screw which can be reversed by a toggle switch. A push button contact switch actuates the dispenser. Again, a screw drive mechanism is employed which is distinguished by the line and gear drive mechanism and the doubled wedges of the present invention.

U.S. Pat. No. 2,837,243 issued on Jun. 3, 1958, to Herbert M. La Zebnik describes a wall mounted automatic but non-motorized toothpaste dispenser with an opening in the lower front face for insertion of the toothbrush. A press plate mounted on springs in the rear of an internal frame has vertical toothed racks on its sides. The geared ends of the longitudinally grooved roller traverse these toothed racks with the aid of a movable pair of vertical racks and are held in vertical grooves in the internal frame. The ejection of toothpaste is actuated by a complex mechanism when the toothbrush is inserted in the opening and stoppage of the toothpaste when the toothbrush is withdrawn. A rubber seal is also actuated to open and close the nozzle with the same mechanism. This automatic dispenser is based on intricate mechanisms dissimilar from the simplified cable-gear mechanism of the present invention. The intricately involved press plate is not considered suggestive of the innovative double wedges of the present invention.

U.S. Pat. No. 4,234,104 issued on Nov. 18, 1980, to Louis J. Apuzzo, Jr. et al. describes a rechargeable battery driven and motorized toothpaste dispenser having a slip clutch mechanism. The battery is located in the top compartment. The motor has two drive wheels at opposite ends which drive vertical and parallel shafts with opposite threading (left-hand and right-hand). A horizontal carriage containing two rollers and ball bearings seated to fit the threading of the shafts traverses vertically to squeeze the toothpaste containing tube. A toggle switch permits reversal of polarity to the motor to reverse the direction of the rollers. A full front cover door is provided for insertion of the toothpaste tube. Automatic operation begins with the toothbrush pushed against a closure member and its spring located in the bottom of the dispenser to contact an on-off push button. The closure member initially seals the tube nozzle. The roller movement is stopped as the toothbrush is withdrawn. This dispenser is distinguished from the present invention in that the mechanism is intricate in having an automatic on-off operation and double rollers moving on double shafts, whereas the present invention has one sliding wedge pressing against a fixed wedge with an inclined surface.

U.S. Pat. No. 5,050,773 issued on Sep. 24, 1991, to Min K. Choi describes a wall mounted electric toothpaste dispenser, wherein the tube is placed vertically with the open nozzle on top and directed horizontally over a toothbrush which actuates a push button. A converter from A.C. to D.C. is provided to supply the electricity to operate the initial downward squeezing force and the automatic upward return motion. Two pliable rollers housed in a carriage traverse up on a vertical screw by a pinion gear positioned on a rack. As the roller carriage nears the top, another contact switch stops the upward motion. The automation, the reversed position of the toothpaste tube, and the lack of a sliding wedge over a fixed wedge with an incline distinguish this reference.

None of the above inventions and patents, taken either singularly or in combination, is seen to describe the instant invention as claimed. Thus, a toothpaste dispenser solving the problems of intricate machinery and owner maintenance is desired.

SUMMARY OF THE INVENTION

A wall mountable toothpaste dispenser is operated by electrical power from a bathroom outlet or a battery. A controlled cylindrical wedge slidingly presses a toothpaste tube against a wedge with an inclined surface for squeezing a dose onto a toothbrush. The roller is moved by a line and pulley system driven by a motor and spur gearing. Any broken lines or other parts other than electrical parts can be repaired by the owner or user of this toothpaste dispenser.

Accordingly, it is a principal object of the invention to provide a toothpaste dispenser which employs lines to move a horizontal cylindrical wedge for squeezing the toothpaste tube against a fixed vertically disposed wedge having an inclined surface.

It is an object of the invention to provide a toothpaste dispenser which is economical and serviceable by the user.

It is another object of the invention to provide a versatile toothpaste dispenser which utilizes a motor driven system operable on either house current or battery.

It is a further object of the invention to provide a toothpaste dispenser made of plastic parts except for the motor and the electrical system.

It is an object of the invention to provide improved elements and arrangements thereof in a toothpaste dispenser for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The FIGURE is a perspective view of a toothpaste dispenser in partial breakaway with the access door opened according to the present invention.

DETAILED DESCRIPTION OF THE PREFERRED EMBODIMENTS

The present invention provides an economical toothpaste dispenser which can be readily repaired by the user and yet prevents unauthorized access by infants to the electrical system.

The FIGURE depicts a toothpaste dispenser device 10 comprising a molded plastic housing 12 consisting of two compartments, i.e., a vertical large or main compartment 14 and a small horizontal compartment 16. The present invention is not to be limited to the shown position of the compartment 16 being on the right side of the dispenser device 10, i.e., the compartment with its internal machinery can be positioned on the left side. The housing 12 has a front wall 18, a first lower sidewall 20, a first upper sidewall 22, a second sidewall 24, a rear wall 26, a top wall 28, an inner wall 30, and a concave bottom wall 32 with an aperture 34 (in shadow), for the nozzle 36 of the toothpaste tube 38 (in phantom). The front wall 18 has a large door 40 on hinges 42, a hidden handle on the outside, and conventional locking closure accoutrements (not shown). The purpose in specifying a large door 40 commensurate in size with the front wall 18 is to enable access to the components within and to insert and remove the toothpaste tube 38. The dispenser 10 is fastened to the wall by conventional means with screws, hook and loop material or a slide-in bracket (not shown).

Inside compartment 14 a first rod 44 and a second rod 46 are positioned horizontally and in parallel in sockets 48 on the second sidewall 24. A critical aspect of the proper positioning of the rods 44, 46 is that the first rod 44 is positioned lower than the second rod 46 in the first and second compartments 14, 16. The first and second rods 44, 46 have respective first and second pulleys 50, 52 on which are attached respective first and second lines 54, 56 which can be monofilament fishing line or the like. A sliding cylindrical wedge 58 has a fixed first short axle 60 on one end and a fixed axle 62 of extended length on the opposite end, which axles are actually one integral axle. The axles 60, 62 are supported, respectively, by inset vertical first groove 64 and second groove 66 formed in the respective first lower sidewall 20 and second sidewall 24. The vertical grooves 64, 66 are proportioned to provide a snug but slidable fit for the axles 60, 62 and extend from the end of the toothpaste tube 38 to proximate the nozzle 36.

A third pulley 68 is positioned on the second sidewall 24 and aligned with the second pulley 52 in order to control the movement of the sliding cylindrical wedge 58 which does not revolve in this device. The lines 54 and 56 are wound and unwound on the respective pulleys 50, 52. The lines 54 and 56 are anchored on the respective pulleys 50, 52 and the second axle 62 by providing apertures in the pulleys and in the second axle. A preferred anchoring method is the provision of depressions (not shown) in each apertured attachment region 70 for attaching split-shots (slotted spherical lead weights used in fishing) to the preferred monofilament fishing lines 54, 56 which can be nylon and the like. The anchoring split shots or knots (not shown) inserted in the depressions do not therefore encumber the winding and unwinding of the lines 54, 56 from the respective pulleys 50, 52. An alternative to the use of two lines 54, 56, would be to utilize a single line which is wrapped around the second axle 62 by traversing the apertured regions 70 shown.

A critical feature of the present invention is the flat surfaced wedge 72 which is secured by either screws, adhesive or hook and loop fasteners (fasteners not shown) to the rear wall 26 and closer to the first lower sidewall 20 in order to provide space for the lines 54, 56. This location requires that the aperture 34 for the nozzle 36 is centered with respect to the wedge 72. The wedge 72 has its thickest portion 74 on top and the thickness decreases gradually to the thin edge 76 on the bottom which abuts the bottom wall 32. The length and width of the wedge 72 is proportional to the largest conventional size of the toothpaste tube available. Optionally, several wedge sizes can be supplied to suit the specific size of the toothpaste tube. A suitable angle of inclination of the exposed surface of wedge 72 can be approximately 5 to 10 degrees.

The second or small compartment 16 contains the electrical and mechanical means for advancing and retracting the sliding cylindrical wedge 58. The first and second rods 44, 46 extend into this compartment from the main compartment 14. First rod 44 is attached to a first spur gear 78 which interlocks or meshes with a second spur gear 80 attached to the second rod 46. A third spur gear or driving gear 82 is attached to an electric motor 84 energized by converted house current from the electrical wire 86 from A.C. to D.C. and reduced in voltage by a circuit board 88. The motor 84 is attached to the bottom wall 33 at a suitable height relative to the desired height required to mesh the third spur gear 82 with the first spur gear 78.

A three-way toggle or momentary flip switch 90 is provided on the top wall 28 surface of the second compartment 16 for a forward movement of the sliding cylindrical wedge 54, an intermediate off position, and a reverse movement. Alternatively, a three-way slide switch can be provided.

The electrical system can rely, alternatively, on a battery source provided either in the small compartment 16 or below it in another added compartment (not shown) attached to the first sidewall 20. The circuit board 88 can be configured to provide this adaptability.

The small compartment 16 can be modular and attached to the first upper sidewall 22 for removal of the first and second spur gears 78, 80 and the respective first and second rods 44, 46 with their respective pulleys 50, 52.

A plastic snap-on nozzle cover 92 with inside ribs 93 and a tether 94 is fastened to the underside of the concave bottom wall 32 and provided adjacent to the toothpaste nozzle 36. This convenient means covers the nozzle 36 instead of losing the cover or laboriously screwing the original threaded cap on and off.

It is contemplated that the toothpaste dispenser 10 of the present invention can be positioned horizontally instead of vertically on the wall so that the toothpaste is dispensed horizontally.

The plastic compositions of the housing 12, planar wedge 72, rods 44, 46, pulleys 50, 52 and 68, cylindrical wedge 58, axles 60, 62, and spur gears 78, 80, 82 can be made from polyethylene, polypropylene, polyacrylate, and/or polyvinyl and the like. Alternatively, the spur gears, pulleys and rods can be made of metal for greater durability. The motor 84 and the circuit wires are substantially made of metal.

The toothpaste dispenser 10 of the present invention is economical in cost and the moving parts are readily replaceable by a user due to the large front door 40 and compartmentalization.

The present invention is not limited to the toothpaste tube, but can be applied to the dispensing of other viscous liquid containing tubular products such as preparations for the hand, body, hair, baby, dentures, and the like.

It is to be understood that the present invention is not limited to the embodiments described above, but encompasses any and all embodiments within the scope of the following claims.

I claim:

1. A toothpaste dispenser comprising:

a plastic housing comprising a small, horizontal upper compartment and an elongated vertical main compartment, the upper compartment being contiguous to the main compartment, the main compartment having a front wall, there being a door in the front wall;

said main compartment comprising a first sidewall and a second sidewall, a rear wall, a top wall, and a concave bottom wall with an outlet aperture;

a vertically disposed planar wedge adjacent to the rear wall with its thinner edge abutting the bottom of said housing, said wedge and housing being dimensioned and configured such that a toothpaste tube can be vertically disposed against the planar wedge with its nozzle protruding from the outlet aperture;

a horizontally disposed cylindrical wedge having a first axle and an oppositely disposed second axle, said cylindrical wedge being pressed against the toothpaste tube and the planar wedge;

a first rod and a second rod, each rod having pulleys proximate to one end as respective first and second pulleys and having respective first and second spur gears at the opposite end;

a third driving spur gear, each first and second spur gear intermeshing with each other, the first spur gear intermeshing with said driving third spur gear;

a first line attached to said first pulley and to said first axle of the cylindrical wedge; and a second line attached to said second pulley and to said first axle of the cylindrical wedge; whereby the cylindrical wedge is slidingly moved down the toothpaste tube by operation of the driving third spur gear to squeeze the toothpaste through the nozzle of the tube onto a toothbrush, and the cylindrical wedge being returned to its original position upon emptying the tube by reversing the operation of the driving third spur gear.

2. The toothpaste dispenser according to claim 1, including a third pulley attached to the second sidewall and below the cylindrical wedge for guiding the second line.

3. The toothpaste dispenser according to claim 1, including means causing reversal of the direction of the cylindrical wedge.

4. The toothpaste dispenser according to claim 1, wherein a length of the cylindrical wedge is coextensive with a flattened diameter of the toothpaste tube.

5. The toothpaste dispenser according to claim 1, including a plastic nozzle cover adapted to being tethered adjacent the outlet aperture for covering the nozzle of the toothpaste tube.

6. The toothpaste dispenser according to claim 1, wherein the dispenser includes means for mounting the dispenser on a vertical wall surface.

7. The toothpaste dispenser according to claim 1, wherein the outlet aperture has a slot for the accommodation of toothpaste tubes with shortened stems.

8. The toothpaste dispenser according to claim 1, there being means defining first and second vertical grooves in the first and second sidewalls, respectively, and wherein the cylindrical wedge has its first axle end supported in a first vertical groove in the first sidewall and a second axle being elongated and its end supported in the second vertical groove of the second sidewall.

9. The toothpaste dispenser according to claim 8, wherein the first and second grooves are inset in the respective first and second sidewalls.

10. The toothpaste dispenser according to claim 1, wherein the first and second lines are monofilament fishing lines.

11. The toothpaste dispenser according to claim 10, wherein the monofilament lines are anchored in apertures having depressions in the second axle, the first pulley and the second pulley by split-shots.

12. The toothpaste dispenser according to claim 1, including an electric motor to drive the third spur gear.

13. The toothpaste dispenser according to claim 12, wherein the first spur gear, the second spur gear, the third spur gear, and the motor are housed in the horizontal compartment.

14. The toothpaste dispenser according to claim 12, including an electrical system to energize the electric motor.

15. The toothpaste dispenser according to claim 14, wherein the electrical system includes a three-way toggle switch.

16. The toothpaste dispenser according to claim 14, wherein the electrical system includes a three-way momentary flip switch.

17. The toothpaste dispenser according to claim 14, wherein the motor is configured to be powered by converted house current.

18. The toothpaste dispenser according to claim 14, wherein the motor is configured to be powered by a battery source.

19. The toothpaste dispenser according to claim 14, including a circuit board in the electrical system, whereby the direction of the cylindrical wedge can be controlled.

20. The toothpaste dispenser according to claim 19, wherein the small horizontal upper compartment comprises a separable module containing the first, second and third spur gears, the electric motor, the electrical system, and the circuit board on the top wall.

* * * * *